US005362626A

United States Patent [19]

Kojima et al.

[11] Patent Number: 5,362,626

[45] Date of Patent: Nov. 8, 1994

[54] SILVER HALIDE PHOTOGRAPHIC LIGHT-SENSITIVE MATERIAL

[75] Inventors: Takaaki Kojima; Mitsuhiro Okumura; Takahiko Nojima, all of Hino, Japan

[73] Assignee: Konica Corporation, Tokyo, Japan

[21] Appl. No.: 128,818

[22] Filed: Sep. 29, 1993

[30] Foreign Application Priority Data

Oct. 14, 1992 [JP] Japan ..... 4-276175

[51] Int. Cl.[5] ..... G03C 1/005

[52] U.S. Cl. ..... 430/642; 430/640; 430/603; 430/605; 430/611; 430/567

[58] Field of Search ..... 430/640, 642, 603, 605, 430/611, 567

[56] References Cited

U.S. PATENT DOCUMENTS

| | | | |
|---|---|---|---|
| 2,191,206 | 2/1940 | Schwartz | 430/642 |
| 4,352,695 | 10/1982 | Tomka | 430/642 |
| 4,360,590 | 11/1982 | Tomka | 430/642 |
| 4,845,023 | 7/1989 | Mifume | 430/642 |
| 5,051,336 | 9/1991 | Inoue et al. | 430/611 |
| 5,264,339 | 11/1993 | Taverinier et al. | 430/642 |

FOREIGN PATENT DOCUMENTS

| | | |
|---|---|---|
| 313949 | 5/1989 | European Pat. Off. . |
| 367572 | 5/1990 | European Pat. Off. . |
| 0136143 | 5/1989 | Japan . |
| 253839 | 11/1991 | Japan . |

OTHER PUBLICATIONS

Research Disclosure, vol. 176, No. 17643 (Dec. 1978), Kenneth Mason Publications Ltd., p. 26.

Glafkides, Photographic Chemistry, vol. one, 1958, Fountain Press, pp. 294–295 and 318.

Rong-gin et al., "Influence of Trace Metal Ions on the Sensitometric Property of the Gelatin Silver Halide Emulsion", Photographic Gelatin, Sep. 1983.

*Primary Examiner*—Thomas R. Neville

*Attorney, Agent, or Firm*—Jordan B. Bierman

[57] ABSTRACT

Disclosed is a silver halide photographic light-sensitive material comprising a support and having thereon at least one silver halide emulsion layer, wherein the silver halide emulsion layer contains a gelatin comprising an iron ion of 0.5 ppm to 5 ppm and α-constituent having weight-average molecular weight of 80,000 to 120,000 in an amount of not less than 40% by weight of the gelatin.

13 Claims, No Drawings

SILVER HALIDE PHOTOGRAPHIC LIGHT-SENSITIVE MATERIAL

FIELD OF THE INVENTION

The present invention relates to a photographic light-sensitive material for making prints, and more particularly to a high-speed photographic light-sensitive material for making prints, whose sensitivity and gradation when processed in a short time after exposure do not fluctuate and whose fogging and sensitivity changing characteristics during its aging storage period are improved.

BACKGROUND OF THE INVENTION

In recent years, in order to hasten the time of delivery as well as to improve the productivity of finished photographic prints, in the photographic light-sensitive material for making prints, there are adopted a method of using a silver halide having a high silver chloride content that is fast developable for rapid processing and a method of raising the sensitivity of the light-sensitive material for shortening the duration of making prints. However, it is virtually impossible to raise the sensitivity of silver chloride because silver chloride tends to easily fog when its sensitivity is tried to be raised or its characteristics are liable to change with time during its storage.

In order to get rid of such the disadvantage of a high-silver-chloride-content silver halide emulsion, various techniques have been disclosed to date. For example, as techniques for increasing the speed of a high-silver-chloride-content silver halide emulsion JP O.P.I. Nos. 95736/1983, 108533/1983, 222844/1985 and 222845/1985 describe that a high-speed emulsion with little fog can be obtained by making a high-silver-bromide-content phase locally present inside the grain or as a surface phase of the grain. According to the investigation by us, the inventors of the invention, however, these techniques surely enable to increase the speed of the emulsion, but make the characteristics thereof very liable to be affected by changes in processing solutions, so that it is hard to make photographic prints of a consistent quality.

JP O.P.I. Nos. 153536/1988 and 86135/1989 describe that the addition of a gold compound to an emulsion in the process of its chemical sensitization makes it possible to highly sensitize the emulsion. As a result of our investigation, it has been found that the above is a suitable sensitization method for the high-silver-chloride-content silver halide emulsion because it makes the emulsion highly sensitive, less fogged and stable against processing solutions. However, a light-sensitive material comprising an emulsion highly subjected to gold sensitization treatment showed a phenomenon of a difference in the sensitivity and gradation between when processed immediately after being exposed and when processed with an intermission after being exposed (the phenomenon is hereinafter referred to as short-time latent image fluctuation). This phenomenon is a behavior peculiar to high-silver-chloride-content silver halide emulsions, which, when the exposure/development interval in the print-making process in minilabs is irregular, largely affects the quality of finished photographic prints, thus being a large stumbling block to making the high-silver-chloride-content light-sensitive material a practical reality. Further, the light-sensitive material comprising a high-silver-chloride-content silver halide emulsion subjected to gold sensitization treatment has the disadvantage that it tends to become fogged during its aging storage after being prepared, e.g., when stored under high temperature/high humidity conditions.

In order to improve the aging stability of the photographic characteristics after exposure of the light-sensitive material, JP E.P. No. 56969/1988 discloses a method for incorporation of a high-molecular benzenesulfinic acid compound into the light-sensitive material. Further, JP O.P.I. No. 113236/1985 discloses the incorporation of an imino group-having compound into the light-sensitive material. These methods, however, have been found to have no effect at all on the improvement of the photographic characteristics fluctuation in a very short time after exposure.

As a result of our continued investigation on the above phenomenon, it has been found that by separately effecting the sulfur sensitization process and the gold sensitization process described in JP O. P. I. No. 136143/1989 to make chemical sensitization, the light-sensitive material can be improved on its short-time latent image fluctuation with its high sensitivity being kept intact. However, no improvement is made on the fog increase during aging storage attributable to the gold sensitization.

In order to restrain the light-sensitive material from fogging during its aging storage, it is known to have the light-sensitive material contain various compounds for example, U.S. Pat. Nos. 2,403,927, 3,266,897 and 3,708,303, JP O.P.I. Nos. 135835/1980 and 71047/1984 describe the incorporation of mercaptotetrazoles, mercaptotriazoles or mercaptodiazoles, but their improving effect is not enough for practical use because their fog-restraining capacity is small and when used in a large amount, they cause desensitization of the light-sensitive material.

SUMMARY OF THE INVENTION

It is therefore an object of the invention to provide a silver halide photographic light-sensitive material excellent in the short-time latent image stability as well as in the antifogging characteristic during its storage over a long period.

The above object of the invention is effectively accomplished by a silver halide photographic light-sensitive material comprising a support having thereon at least one silver halide emulsion layer, in which the silver halide emulsion layer contains gelatin comprising an iron ion of 0.5 ppm to 5 ppm and an $\alpha$ constituent having a weight-average molecular weight of 100,000 in an amount of 40% by weight.

DETAILED DESCRIPTION OF THE INVENTION

The gelatin used in the invention is explained.

The gelatin normally used in the photographic industry includes alkali-treated gelatin, which is treated with lime, and acid-treated gelatin, which is treated with an acid such as hydrochloric acid in the process of manufacturing from collagen, and these are produced generally from cattle bones, oxhide, pigskin, etc., as raw materials.

Details about the manufacture and characteristics of such kinds of gelatin are described in Arthur Veis, 'The Macromolecular Chemistry of Gelatin,' Academic Press, pp.187–217 (1964); T. H. James, 'The Theory of the Photographic Process,' 4th ed., 1977 (Macmillan), p.55; Kagaku Shashin Benran (Vol.1), pp.72–75; and Shashin Kogaku no Kiso-Gin'en Shashin pp.119–124 (Corona).

Gelatin is generally composed of collagen's constituting units including $\alpha$ constituent (weight-average molecular weight: 80,000 to 120,000) and its dimer and trimer, $\beta$ constituent and $\gamma$ constituent, respectively; a polymer, a macromolecular constituent; and low-molecular constituents consisting of irregularly cut fragments of these constituents as described in D. Lorry and M. Vedrines, Proceedings of the 4th IAG Conference, Fribourg, September 1983, p.35; and Takashi Ohno, Hiroyuki Kobayashi, Shin Mizusawa et al, Journal of The Society of Photographic Science and Technology of Japan, p.47, 237 (1984). Determination of the molecular weight distribution of gelatin is carried out by Gel Permeation Chromatography (hereinafter abbreviated to GPC) as described in the above-mentioned publications, JP O.P.I. Nos. 80838/1985, 87952/1987, 265645/1987, 279329/1987 and 46742/1989. The proportion of the $\alpha$ constituent of the gelatin used in the invention is found according to GPC under the following conditions.

GPC a) Column: Asahipak GS-620, manufactured by Asahi Kasei Co. Two columns connected in series Column temperature: 50° C.

b) Eluate: a mixture of 0.1M $KH^2PO^4$ and 0.1M $Na^2HPO^4$ at pH6.8 at a flow rate of 1.0ml/min.

c) Sample: 0.2% gelatin eluate solution Injection amount: 100$\mu$l d) Detection: by a UV absorption spectrophotometer (UV wavelength: 230nm)

In a chart showing changes in the absorption at 230nm with retention time, there first appears an elimination limit peak, followed by the peaks of $\gamma$, $\beta$ and $\alpha$ constituents appearing in sequence in the described order, and the curve becomes forming with a gently-sloping foot as the retention time is prolonged.

The proportion of the a constituent in the invention to the whole can be found by calculating the percentage of the area of the peak of $\alpha$ constituent accounting for of the whole area. To be concrete, a vertical line b is drawn onto the horizontal axis from the minimum point next on the left side of the $\alpha$ constituent's peak a that appears at around 23 minutes of retention time (in the direction of retention time being smaller). Next, a vertical line c is drawn onto the horizontal axis in the position of +1.5 minutes of retention time from the peak $\alpha$. And a calculation is made on what percent by weight the area surrounded with the measuring lines b and c and the base line accounts for of the whole area.

The proportion of the $\alpha$ constituent of gelatin used in the invention found by the above method is preferably not less than 40% by weight, and more preferably not less than 45% by weight.

Regarding the proportion of the $\alpha$ constituent in the invention, in the case of obtaining a desired gelatin by blending the gelatin of the invention with other gelatin different in the $\alpha$ constituent value, even if either one of the $\alpha$ constituents of gelatins to be blended is of less than 40% by weight, there is no problem at all as long as the resulting $\alpha$ constituent proportion after blending is not less than 40% by weight.

The percentage of the high molecular weight constituent accounting for of the gelatin used in the invention is preferably not more than 3%. The proportion of the high molecular weight constituent to gelatin in the invention can be found by making a calculation of what percent the elimination limit peak's area accounts for of the whole area. To be concrete, a vertical line is drawn onto the horizontal axis from the minimum point next to the peak that appears at around 15 minutes of retention time, and the percentage of the area on the left side of the vertical line (high molecular weight constituent) accounting for of the whole area is calculated.

The gelatin used in the invention may be either a lime-treated gelatin or an acid-treated gelatin, and may be one produced from any of cattle bones, oxhide or pigskin, but preferably a lime-treated gelatin manufactured from cattle bones.

The jelly strength (according to PAGI method) of the gelatin used in the invention is preferably not less than 250g. The calcium content of the gelatin (according to PAGI method) of the invention is preferably not more than 6000ppm, and more preferably not more than 5000ppm. To lower the calcium content of the gelatin of the invention, the treatment by use of an ion-exchange resin column is generally suitably used.

The gelatin of the invention may also be subjected to oxidation treatment with use of hydrogen peroxide for the purpose of decreasing its photographic activity.

Means to increase the $\alpha$ constituent having a weight-average molecular weight of 80,000 to 120,000 in obtaining the gelatin of the invention, for example, are provided as follows:

(1) Adjusting conditions of temperature and others for the duration of subjecting the raw material to lime treatment.

(2) Making the extraction of gelatin from pretreated raw materials into a water phase at a temperature as relatively low as 50° to 60° C. for an adjusted period of time. As for the extraction, generally first, second and third extraction steps are made in sequence, but the first extract obtained in a short-time extraction is preferred.

(3) Making the concentration, gelling and drying of the extracted gelatin solution for obtaining gelatin at a temperature as low as possible (not more than 40° C.) in order to avoid its thermal decomposition. Preferably, the concentration should be made under reduced pressure or according to a ultrafiltration method.

(4) The use of a molecular-weight differentiation method employing a ultrafilter.

(5) Application of a molecular-weight differentiation method according to the coacervation process which employs an organic solvent such as alcohols is used.

The above-mentioned means are used alone or in combination, whereby the gelatin of the inventione can be obtained.

The iron ion-content of the gelatin of the invention is preferably not more than 5ppm, and more preferably not more than 3ppm. The control to keep the iron ion content not more than 5ppm is generally carried out by ion-exchange treatment which uses an ion-exchange resin. However, the removal by the ion-exchange treatment of a very slight amount of iron ion from gelatin is not necessarily effective depending on the kind of ion-exchange resin used. Utilization of chelating resins, extraction with a solvent or a foam separation method may also be used for this purpose. In addition, production of gelatin by use of raw materials containing little or no iron is effective in reducing the iron content of gelatin, and further it is also effective in decreasing the iron content of gelatin to avoid mixing-in of iron from the manufacturing equipment in the manufacturing process of gelatin or to remove mixed-in iron powder by a magnet.

The preferred among the above manners is a method for removing iron by adding a water-soluble salt and/or a water-soluble base to the gelatin extract solution, and then treating the solution with an anion-exchange resin to obtain a processed solution having pH 9.0 or above.

The gelatin of the invention is normally used in the process of preparation for coating the silver halide emulsion layer, but may also be used in the process of preparation for coating the non-light-sensitive layer.

The silver halide emulsion contained in the coating liquid of the invention is a silver chlorobromide emulsion which does substantially not contain silver iodide and 95 mol% or more of which is silver chloride. The chemical ripening process for the emulsion preferably comprises a sulfur sensitization process and a gold sensitization process subsequent thereto.

As for the distinction between a sulfur sensitization process and a subsequent gold sensitization process, as the time interval between the start of the sulfur sensitization and that of the gold sensitization it is preferable to start the gold sensitization before the sensitivity increase by the sulfur sensitization reaches logE 0.3 and after the passage of 60 or more minutes. Commencing the gold sensitization after the sensitivity increase from the sulfur sensitization process reaches logE 0.3 or more is undesirable because it causes a sharp increase in fog, desensitization and contrast reduction to occur. Commencing the gold sensitization 60 or more minutes after the start of the sulfur sensitization is preferred because it effectively contributes to fog reduction and contrast increase. The chemical ripening conditions are adjusted so as to meet the above requirements.

The sulfur sensitizer used in the sulfur sensitization process for the silver halide emulsion according to the invention includes thiosulfates, allylthiocarbamide, thiourea, allylisothiocyanate, cystine, p-toluenesulfonateo rhodanine, inorganic sulfur and the like. Other sulfur sensitizers as described in U.S. Pat. Nos. 1,574,944, 20410,689 and 2,278,974 can also be used. The adding amount of the sulfur sensitizer largely varies depending on various conditions such as pH, temperature and silver halide grain sizes, but, as a standard, is preferably $10^{-7}$ mol to $10^{-3}$ mol, more preferably $10^{-6}$ mol to 10−5 mol per mol of silver halide.

The gold sensitizer applicable to the silver halide emulsion of the invention includes various gold complex compounds formed from chloroauric acid, gold sulfide, gold thiosulfate and the like. The usable chelating agents include dimethyl rhodanine, thiocyanic acid, mercaptotetrazole and mercaptotriazole. The using amount of the gold compound differs according to the kind of silver halide emulsion used, the kind of compound used, ripening conditions, and the like, but is preferably $1\times10^{-4}$ mol to $1\times10^{-8}$ mol, more preferably $1\times10^{-5}$ mol to $1\times10^{-8}$ mol per mol of silver halide. The sensitization of the silver halide emulsion of the invention may also be made in arbitrary combination with reduction sensitization or noble-metal sensitization.

In the invention, where the photographic light-sensitive material is required to contain an antifoggant, the antifoggant is added in the form of a solution of it dissolved in a water-miscible organic solvent including an alcohol such as methanol, ethanol, an ester such as ethyl acetate, a ketone such as acetone, or in the form of an aqueous solution of it dissolved in water to the hydrophilic colloid solution for coating layers of the light-sensitive material.

The antifoggant used in the invention includes those compounds represented by Formula II described in the lower column of p.7 of JP O.P.I. No. 146036/1990, and useful ones are the exemplified compounds IIa-1 to IIa-8 and IIb-1 to IIb-7 described in p.8 of the same publication and 1-(3-methoxyphenyl)-5-mercaptotetrazole.

The preferred among these compounds are those represented by the following formula:

Formula I

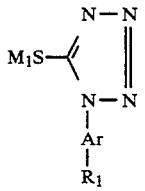

wherein Ar represents an aromatic group; $R_1$ represents —OR2, —N($R_3$)$SO_2R_4$ or —$COOM_2$, wherein $R_2$ is a hydrocarbon group having two or more carbons, $R_3$ is a hydrogen atom or a hydrocarbon group and $R_4$ is a hydrocarbon group; and $M_1$ and $M_2$ each represent a hydrogen atom, an alkali metal atom, an alkaline earth metal atom or an ammonium group.

In Formula I, Ar represents an aromatic group such as phenyl, naphthyl or pyridyl. The aromatic group may have a substituent. When Ar is a phenyl group, it causes the invention's effect to appear remarkably.

In Formula I, $R_1$ represents —$OR_2$, —N($R_3$)$SO_2R_4$ or —$COOM_2$, wherein $R_2$ is a hydrocarbon group having 2 or more carbons, including an alkyl group such as ethyl, hexyl or dodecyl, a phenyl group, an aryl group such as p-(t)-butylphenyl, m-methoxyphenyl or o-methoxyphenyl. When $R_2$ is an alkyl group, the invention's effect appears remarkably. $R_1$ is preferably —N($R_3$)$SO_2R_4$ or —$OR_2$, and most preferably —N($R_3$)$SO_2R_4$.

$R_3$ represents a hydrogen atom or a hydrocarbon group. Examples of the hydrocarbon group include a methyl group and the same groups as defined for $R_2$. When $R_3$ is a hydrogen atom, the invention's effect appears remarkably.

$R_4$ represents a hydrocarbon group, which includes the same groups as defined for $R_3$. When $R_4$ is an alkyl group, the invention's effect appears remarkably.

In Formula I, $M_1$ and $M_2$ each represent a hydrogen atom, an alkali metal atom, an alkaline earth metal atom or an ammonium group. Examples of the metal atom include sodium, lithium, potassium and calcium. Where the metal atom is divalent or multivalent, anions are bonded thereto to neutralize its charge. When $M_1$ is a hydrogen atom, the invention's effect appears remarkably.

Compounds represented by Formula I are exemplified below. The invention is not restricted by the exemplified compounds.

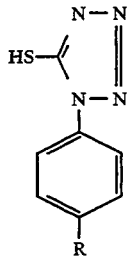
| No. | R |
|---|---|
| 1 | $-OCH_2CH_3$ |
| 2 | $-O(CH_2)_3CH_3$ |
| 3 | $-O(CH_2)_5CH_3$ |
| 4 | $-O(CH_2)_7CH_3$ |
| 5 | $-O(CH_2)_{11}CH_3$ |
| 6 | 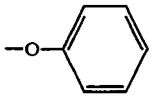 |
| 7 | 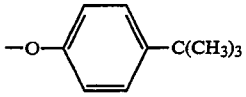 |
| 8 | 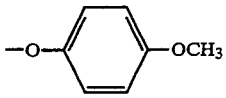 |
| 9 | 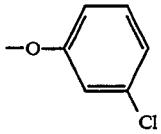 |
| 10 | 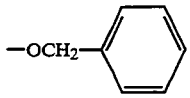 |
| 11 | $-OCH_2CH{=}CH_2$ |
| 12 | $-OCH_2C{\equiv}CH$ |
| 13 | $-NHSO_2CH_3$ |
| 14 | $-NHSO_2(CH_2)_3CH_3$ |
| 15 | $-NHSO_2CH(CH_3)_2$ |
| 16 | 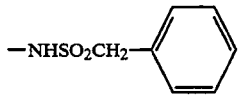 |
| 17 | $-NHSO_2CH_2CF_3$ |
| 18 | $-NHSO_2(CH_2)_3Cl$ |
| 19 | 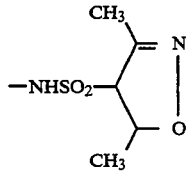 |
| 20 | 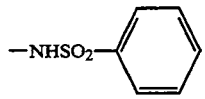 |
-continued
| No. | R |
|---|---|
| 21 | 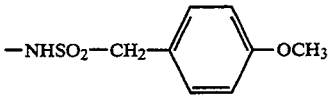 |
| 22 | $-NHSO_2CH_2CH{=}CH_2$ |
| 23 | $-NHSO_2CH_2C{\equiv}CH$ |
| 24 | $-NHSO_2N(CH_3)_2$ |
| 25 | $-NHSO_2(CH_2)_7CH_3$ |
| 26 | $-COOH$ |
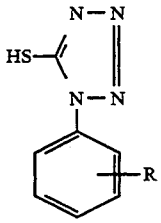
| No. | R |
|---|---|
| 27 | o-$OCH_2CH_3$ |
| 28 | o-$O(CH_2)_3CH_3$ |
| 29 | 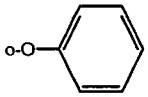 |
| 30 | 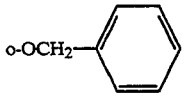 |
| 31 | o-$OCH_2CH{=}CH_2$ |
| 32 | m-$OCH_2CH_3$ |
| 33 | m-$O(CH_2)_5CH_3$ |
| 34 | 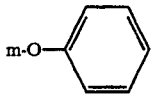 |
| 35 | 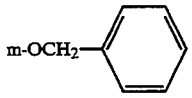 |
| 36 | o-$NHSO_2CH_3$ |
| 37 | o-$NHSO_2(CH_2)_2CH_3$ |
| 38 | 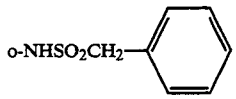 |
| 39 | o-$NHSO_2CH_2CH{=}CH_2$ |
| 40 | m-$NHSO_2CH_3$ |
| 41 | m-$NHSO_2(CH_2)_3CH_3$ |
| 42 | m-$NHSO_2CH(CH_3)_2$ |
| 43 | 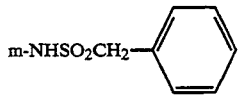 |
| 44 | 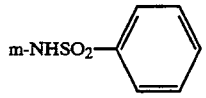 |

-continued

| No. | R |
|---|---|
| 45 | m-$NHSO_2N(CH_3)_2$ |
| 46 | m-$NHSO_2(CH_2)_7CH_3$ |
| 47 | m-COOH |
| 48 | m-COONa |
| 49 | 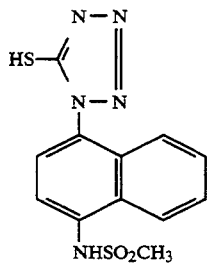 |
| 50 | 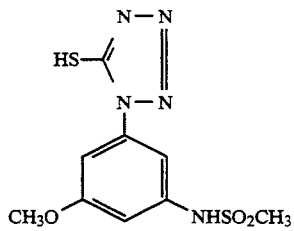 |
| 51 | 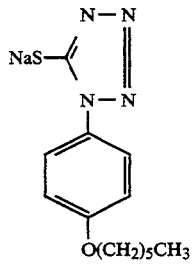 |
| 52 | 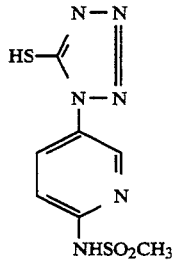 |

For the syntheses of the above compounds reference can be made to J. Chem. Soc., 49 1748 (1927); J. Org. Chem., 39 2469 (1965); JP O.P.I. No. 89034/1975; Ann. Chim., 44-3, 1954; JP E.P. No. 28496/1965; Che. Ber., 20 231 (1887); and U.S. Pat. No. 3,259,976.

The above compound is added to the silver halide emulsion in its grains preparation process, in its chemical sensitization process, upon completion of its chemical sensitization process or in its coating liquid preparation process depending on the purpose for which it is used. Where the chemical sensitization is made in the presence of the above compound, the compound is used in an amount of $1\times10^{-5}$ mol to $5\times10-4$ mol per mol of silver halide. When added upon completion of the chemical sensitization its using amount is preferably $1\times10^{-6}$ mol to $\times10^{-2}$ mol, more preferably $\times10^{-5}$ mol to $5\times10^{-3}$ mol per mol of silver halide. When added to the silver halide emulion in its coating liquid preparation process, its using amount is preferably $1\times10^{-6}$ mol to $1\times10^{-1}$ mol, more preferably $1\times10^{-5}$ mol to $1\times10^{-2}$ mol per mol of silver halide. When added to a non-silver halide emulsion layer, its amount contained in the coating liquid therefor is preferably $1\times10^{-9}$ mol to $1\times10^{-3}$.

Where the silver halide photographic light-sensitive material of the invention is a color photographic light-sensitive material, it has silver halide emulsion layers spectrally sensitized to specific wavelength regions ranging from 400 to 900 nm in combination with yellow coupler, magenta coupler and cyan coupler. The above silver halide emulsion contains one or more different sensitizing dyes in combination.

As the spectral sensitizing dyes for the silver halide emulsion of the invention there may be used any of those known compounds for this purpose. As the sensitizing dye for the blue-sensitive layer the Compounds BS-1 to BS-8 described in p.108–109 of JP Application No. 51124/1990 may be used alone or in combination. As the sensitizing dye for the green-sensitive layer the Compounds GS-1 to GS-5 described in p.110 of the same publication may be suitably used. As the sensitizing dye for the red-sensitive layer the Compounds RS-1 to RS-8 described in p.111–112 of the same publication may be suitably used. Where the silver halide photographic light-sensitive material of the invention is exposed to make prints by use of a semiconductor laser-equipped printer, the light-sensitive material requires the use of a sensitizing dye sensitive to infrared light, and as the infrared-sensitive sensitizing dye the Compounds IRS-1 to IRS-11 described in p.12–14 of JP Application No. 73619/1991 may be suitably used. Also, it is preferable to use the supersensitizers SS-1 to SS-9 described in p.14–15 of the same specification in combination with these dyes.

In the silver halide photographic light-sensitive material of the invention dyes having absorptions in various wavelength regions may be used for antiirradiation and antihalation purposes. For such purposes any appropriate known compounds may be used; particularly as dyes having absorptions in the visible range the dyes AI-1 to AI-11 described in p.117–118 of JP Application No. 51124/1990 are suitably usable. As infrared absorption dyes those compounds represented by the Formulas (I), (II) and (III) described at the left lower column in p.2 of JP O.P.I. No. 280750/1989 are preferred in respect of having suitable spectral characteristics, having no influence upon various characteristics of the silver halide, and leaving no residual color causing a color stain. Useful examples of these compounds are the exemplified compounds (1) to (45) given in the section described from the lower left column in p.3 to the lower left column in p.5 of the same specification.

Dye forming couplers for the light-sensitive material of the invention are normally selected so as to enable the formation of dyes that absorb the spectral lights to which the emulsion layers of the light-sensitive material are sensitive; a yellow dye-forming coupler is used for the blue-sensitive emulsion layer, a magenta dye-forming coupler for the green-sensitive emulsion layer and a cyan dye-forming coupler for the red-sensitive emulsion layer. However, a color light-sensitive material may be prepared in other coupler/layer combinations different from the above ones.

In the invention, as the yellow dye-forming coupler there may be suitably used acylacetanilide couplers, amoung which benzoylacetanilide and pivaloylacetanilide compounds are advantageous.

The following are useful examples of the yellow coupler for the invention.
YC-1
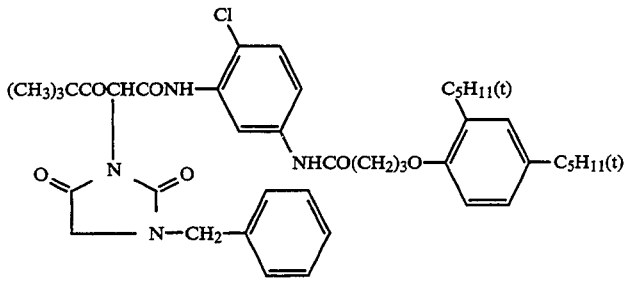
YC-2
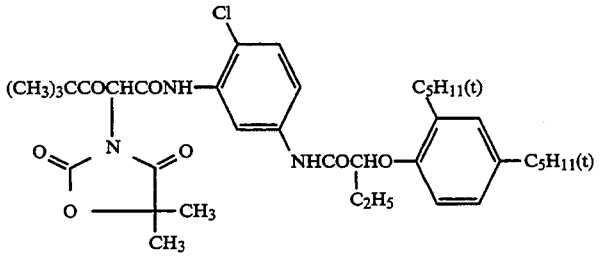
YC-3
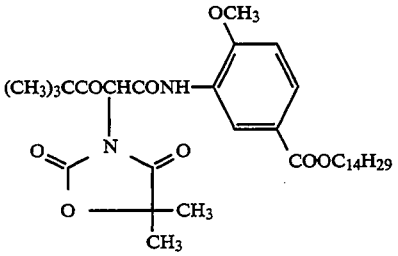
YC-4
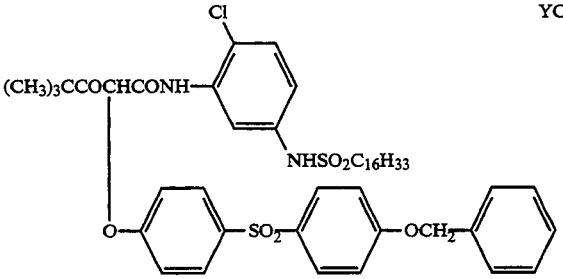
YC-5
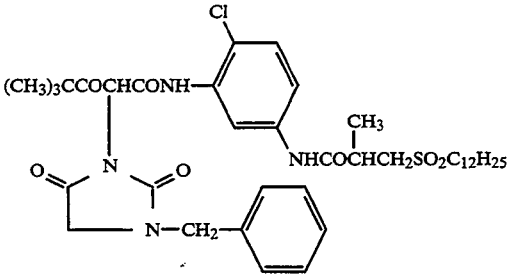
YC-6
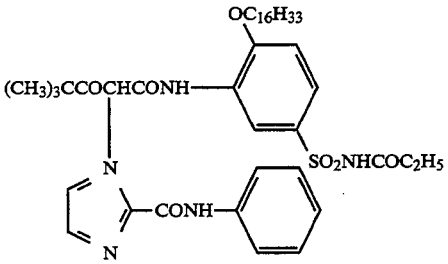
YC-7
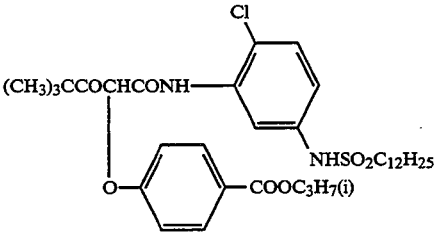
YC-8
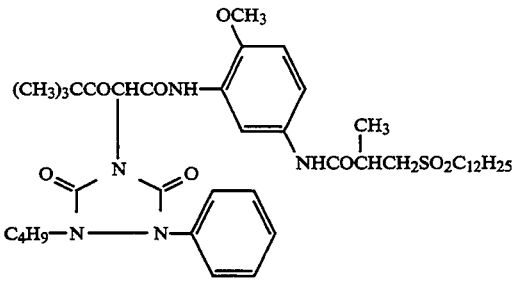

-continued

YC-9

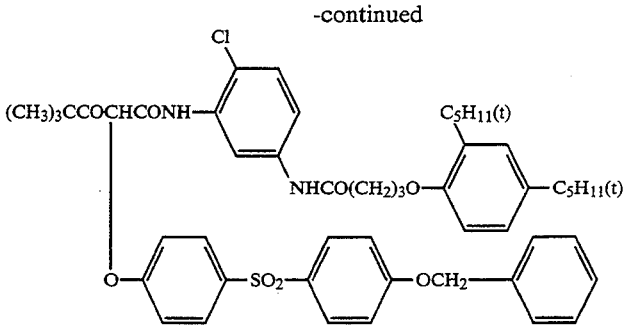

YC-10

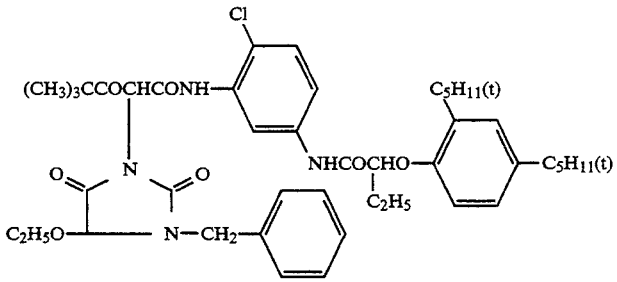

YC-11

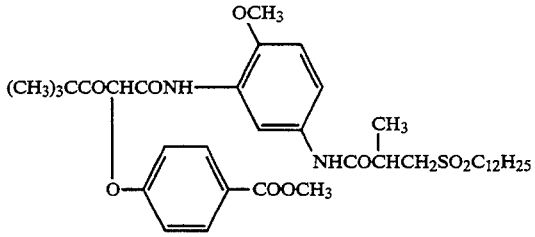

Besides the above compounds, there are the exemplified Compounds Y-1 to Y-146 described in p.7–16 of JP O.P.I. No. 85631/1988; the exemplified Compounds Y-1 to Y-98 described in p.6–10 of JP O.P.I. No. 37951/1988; the exemplified Compounds Y-1 to Y-24; the exemplified Compounds I-1 to I-50 described in p.4–7 of JP O.P.I. No. 298943/1990; and the exemplified compounds Y-1 to Y-48 described in p.114–120 of JP O.P.I. No. 215272.

Those other than the yellow couplers usable in the silver halide photographic light-sensitive material of the invention are magenta couplers having the spectral absorption maximum in the wavelength range of 500 to 600 nm and cyan couplers having the spectral absorption maximum in the wavelength range of 600 to 700 nm.

The magenta coupler suitably applicable to the silver halide photographic light-sensitive material of the invention includes the exemplified Compounds 1 to 223 described in p.18–32 of JP O.P.I. No. 166339/1987; the exemplified Compounds M-1 to M-29 described in p.5–6 of JP O.P.I. No. 100048/1990; the exemplified Compounds M-1 to M-30; and the exemplified Compounds M-1 to M-47 described in p.104–114 of JP O.P.I. No. 215272/1987.

The cyan coupler suitably applicable to the silver halide photographic light-sensitive material of the invention includes those couplers represented by the Formulas C-I to C-II described in p.17 of JP Application No. 234208/1990 and the Compounds CC-1 to CC-9 described in p.18–21 of the same specification.

Where the addition of couplers to the silver halide photographic light-sensitive material of the invention is made according to an oil-in-water-type emulsification/-dispersion method, the coupler is dissolved in a water-insoluble high-boiling organic solvent having a boiling point of not less than 150° C. at need in combination with a low-boiling and/or water-soluble organic solvent, and the solution is emulsifiedly dispersed with a surfactant into a hydrophilic binder such as an aqueous gelatin solution by means of a stirrer, a homogenizer, a colloid mill, a flow jet mixer or a ultrasonic disperser. After or simultaneously with the dispersion, a step of removing the low-boiling solvent may be inserted into the dispersing process. Exsamples of the high-boiling organic solvent applicable to the above coupler dispersing process include phthalates such as dioctyl phthalate, and phosphates such as tricresyl phosphate. The use of a phthalate makes the effect of the invention better.

The coupler dispersion may also be made otherwise; in place of the above high-boiling organic solvent-using method, the coupler and a water-insoluble/organic-solvent-soluble polymer compound are dissolved in a low-boiling solvent and/or water-soluble organic solvent, and the solution is emulsifiedly dispersed with use of a surfactant into a hydrophilic binder such as an aqueous gelatin solution by various dispersing means. The water-insoluble/organic-solvent-soluble polymer used in this instance is preferably poly(N-t-butylacrylamide).

For the purpose of shifting the absorption wavelength of the color-forming dye, there may be used the Compound d-11 described in p.33 and the Compound A'-1 in p.35 of JP Application No. 234208/1990, and the fluorescent dye-releasing compound described in U.S. Pat. No. 4,774,187.

The coating amount of the coupler is not particularly restricted as long as it enables to provide an adequately high density, but is preferably $1\times10^{-3}$ mol to 5 mols, more preferably $1\times10^{-2}$ mol to 1 mol per mol of silver halide.

Gelatin is used as the binder for the silver halide photographic light-sensitive material of the invention, and may be used, if necessary, in combination with other hydrophilic colloids, including different gelatin, gelatin derivatives, graft polymers of gelatin with other high molecular materials, non-gelatin proteins, sugar derivatives, cellulose derivatives, synthetic hydrophilic high molecular materials such as homo-or copolymers.

The reflective support according to the invention may be one of any such materials as white pigment-containing polyethylene-laminated paper, baryta paper, vinyl chloride sheets, white pigment-containing polypropylene or polyethylene terephthalate sheets. The most preferred among these is a support having on its surface a white pigment-containing polyolefin resin layer.

The white pigment usable for the reflective support of the invention is inorganic and/or organic pigment, and preferably an inorganic pigment, examples of which include alkaline earth metals sulfates such as barium sulfate, alkaline earth metals carbonates such as calcium carbonate, powdery silicic acid, silicas such as synthetic silicates, calcium silicate, alumina, alumina hydrate, titanium oxide, zinc oxide, talc, clay, etc. The preferred among these are barium sulfate and titanium oxide.

The white pigment content of the surface waterproof resin layer of the reflective support of the invention is preferably not less than 10% by weight, more preferably not less than 13% by weight, and most preferably not less than 15% by weight of the whole amount of the waterproof resin. The dispersibility of the white pigment inside the waterproof resin layer on the support of the invention can be measured according to the method described in JP O.P.I. No. 28640/1990. The white pigment's dispersibility, when measured with this method, is preferably not more than 0.20, more preferably not more than 0.15, and most preferably not more than 0.10 as the coefficient of variation described in the above publication.

The silver halide photographic light-sensitive material of the invention may be prepared by coating its layers directly on or indirectly through a subbing layer on the support whose surface is at need subjected to corona discharge treatment, UV irradiation treatment or flame treatment, said subbing layer consisting of a single layer or two or more subbing sublayers for the purpose of improving the support's surface characteristics such as adhesion characteristic, antistatic characteristic, dimensional stability, wear resistance, hardness, antihalation characteristic, friction characteristic and/or other characteristics.

A viscosity increasing agent may be used in order to improve the coatability when coating silver halide emulsion layers and other layers of the photographic light-sensitive material of the invention. As the coating method the extrusion coating or curtain coating method capable of coating two or more different layers simultaneously is particularly useful.

The color developing agent for a color developer for use in processing the silver halide photographic light-sensitive material of the invention includes aminophenol and p-phenylenediamine compounds, which are widely used in various color photographic processes. Especially, aromatic primary amine color developing agents are suitably usable.

Examples of the aromatic primary amine color developing agent include:

(1) N,N-dimethyl-p-phenylenediamine hydrochloride,
(2) N-methyl-p-phenylenediamine hydrochloride,
(3) 2-Amino-5-(N-ethyl-N-dodecylamino)toluene,
(4) N-ethyl-N-(β-methanesulfonamidoethyl)-3-methyl-4-aminoaniline sulfate,
(5) N-ethyl-N-(β-hydroxyethyl)-3-methyl-4-aminoaniline sulfate,
(6) 4-Amino-3-methyl-N,N-diethylaniline,
(7) 4-amino-N-(β-methoxyethyl)-N-ethyl-3-methylaniline-p-toluene sulfonate,
(8) 4-Amino-N-ethyl-N-(γ-hydroxypropyl)-3-methylaniline-p-toluene sulfonate.

Any of the above color developing agents may be used in an amount of preferably $1\times10^{-3}$ mol to $2\times10^{-1}$ mol, more preferably $5\times10^{-3}$ mol to $2\times10^{-1}$ mol per liter of a developer solution.

In addition to the above color developing agent, the color developer solution may also contain known developer constituent compounds, such as an alkali agent having a buffer function, chloride ions, a development accelerator such as benzotriazole, a preservative, a chelating agent, and the like.

The alkali agent usable in the color developer solution for the silver halide photographic light-sensitive material of the invention is potassium carbonate, potassium borate or trisodium phosphate. The pH of the color developer solution is normally 9 to 12, and preferably 9.5 to 11.

Halide ions are often used for the purpose of development restraining. In the image-forming method of the invention, however, chloride ions are mainly used, such as potassium chloride or sodium chloride, to meet the need for completion of the development in a shortest possible time. The using amount of such chloride ions is preferably not less than $3.0\times10^{-2}$ mol, more preferably $4.0\times10^{-2}$ mol to $5.0\times10^{-1}$ mol per liter of a color developer solution. The use of Bromide ions is allowed within limits not to impair the effect of the invention; its development restraining effect is remarkable, so that its using amount is preferably not more than $1.0\times10^{-3}$ mol, more preferably not more than $5.0\times10-4$ mol per liter of a color developer solution.

Useful examples of the preservative include hydroxylamine derivatives (excluding hydroxylamine), hydroxamic acids, hydrazines, hydrazidoaminoketones, saccharides, monoamines, diamines, polyamines, quaternary ammonium salts, nitroxyradicals, alcohols, oximes, diamide compounds and condensed-ring amines. Particularly, dialkyl-substituted hydroxylamines such as diethylhydroxylamine and alkanolamines such as triethanolamine are suitably usable.

As the chelating agent applicable to the color developer solution of the invention there may be used compounds such as aminopolycarboxylic acids, aminopolysulfonic acids, alkylsulfonic acids and phosphonocarboxylic acid; particularly, ethylenediaminetetraacetic acid, nitrilotriacetic acid, diethylenetriaminepentaacetic acid and 1-hydroxyethylidene-1,1-diphosphonic acid.

The color developing of the light-sensitive material of the invention is made usually at a temperature of not less than 15° C. and generally in the range of 20° to 50° C. For rapid processing, the color developing is preferably made at a temperature of not less than 30° C.

The color developing time is generally from 10 seconds to 4 minutes, but preferably 10 seconds to 1 minute for rapid processing, and 10 seconds to 30 seconds for further rapid processing.

In the image-forming method of the invention, a running processing is made with the color developer solution being replenished continually. The color developer solution replenishing amount in this instance, since it is desirable to require virtually no overflow in running processing when taking into account the environmental pollution due to recent developer wastes, is preferably 20 to 60 ml.

The silver halide photographic light-sensitive material of the invention, after its color developing, is subjected to bleaching treatment and fixing treatment. The bleaching treatment may be made simultaneously with the fixing treatment. After the fixing treatment, the light-sensitive material is usually subjected to washing treatment. The washing treatment may be replaced by stabilization treatment. A processor for use in processing the silver halide photographic light-sensitive material of the invention may be either of the roller transport type, in which the rollers arranged inside its processing baths nip and transport a light-sensitive material to be processed, or of the endless belt type, in which the belt moves to transport a light-sensitive material fixed thereto. Particularly, the processor may also be of the type of having processing baths formed with slits, through which processing solutions are supplied and at the same time a light-sensitive material is transported.

EXAMPLES

Example 1

Preparation of blue-sensitive silver halide emulsion

To 1,000 ml of a 2% gelatin aqueous solution warmed to 40° C. the following Solution A and Solution B were added spending 30 minutes with pAg and pH being controlled to 6.5 and 3.0, respectively, and further the following Solution C and Solution D were added spending 180 minutes with pAg and pH being controlled to 7.3 and 5.5, respectively. The pAg control herein was made in accordance with the method described in JP O.P.I. No. 45437/1984, while the pH control was made by use of sulfuric acid or sodium hydroxide.

| | |
|---|---|
| Solution A | |
| Sodium chloride | 3.42 g |
| Potassium bromide | 0.07 g |
| Water to make | 200 ml |
| Solution B | |
| Silver nitrate | 10 g |
| Water to make | 200 ml |
| Solution C | |
| Sodium chloride | 102.7 g |
| Potassium bromide | 2.10 g |
| Water to make | 600 ml |
| Solution D | |
| Silver nitrate | 300 g |
| Water to make | 600 ml |

After completion of the addition a 5% aqueous solution of Demol N, produced by Kawo Atlas Co., and an aqueous 20% magnesium sulfate solution were used to make desalting, and then the obtained silver halide was mixed with an aqueous gelatin solution, whereby a monodisperse cubic grains emulsion EMP-1 having an average grain diameter of 0.85μm, a variation coefficient (S/R) of 0.07 and a silver chloride content of 99.0 mol % was obtained.

Emulsion EMP-1 was subjected to 240 minutes of chemical ripening at 50° C. with use of the following compounds, whereby a blue-sensitive silver halide emulsion Em B-1 was obtained.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mol/mol of AgX |
| Sensitizing dye BS-1 | $4 \times 10^{-4}$ mol/mol of AgX |
| Sensitizing dye BS-2 | $1 \times 10^{-4}$ mol/mol of AgX |

The chemical ripening of the emulsion made progress with sodium thiosulfate added at the commencement thereof, sensitizing dyes BS-1 and BS-2 added two minutes thereafter, and chloroauric acid further two minutes thereafter, and 240 minutes after the commencement, stabilizer STAB-1 was added to thereby complete the chemical ripening process.

In contrast, the time interval between the additions of sodium thiosulfate and chloroauric acid was varied as shown in Table 1, whereby Emulsions Em B-2 to B-6 were prepared.

Preparation of green-sensitive silver halide emulsion

A monodisperse cubic grains emulsion EMP-2 having an average grain diameter of 0.43 μm, a variation coefficient (S/R) of 0.07 and a silver chloride content of 99.0 mol % was obtained in the same manner as in EMP-1 except that the adding periods of time of Solutions A and B and Solutions C and D were changed.

Emulsion EMP-2 was subjected to 120 minutes of chemical ripening at 55° C. with use of the following compounds, whereby a green-sensitive silver halide emulsion Em G-1 was obtained.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mol/mol of AgX |
| Sensitizing dye GS-1 | $4 \times 10^{-4}$ mol/mol of AgX |

The chemical ripening of the emulsion began with the addition of sodium thiosulfate, chloroauric acid was added after 60 minutes of ripening, and 60 minutes thereafter stabilizer STAB-1 was added, whereby the ripening was completed.

Preparation of red-sensitive silver halide emulsion

A monodisperse cubic grins emulsion EMP-3 having an average grain diameter of 0.50μm, a variation coefficient (S/R) of 0.08 and a silver chloride content of 99.0 mol % was prepared in the same manner as in EMP-1 excep that the adding periods of time of Solutions A and B and Solutions C and D were changed.

Emulsion EMP-3 was subjected to 150 minutes of chemical ripening at 60° C. with use of the following compounds to thereby obtain a red-sensitive silver halide emulsion Em R-1.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mol/mol of AgX |
| Sensitizing dye RS-1 | $1 \times 10^{-4}$ mol/mol of AgX |

Sodium thiosulfate was added to the emulsion in the beginning of its chemical ripening, chloroauric acid was added after 90 minutes of ripening, sensitizing dye RS-1 was added after 55 minutes of ripening, and 5 minutes thereafter stabilizer STAB-1 was added to thereby complete the chemical ripening.

The thus obtained emulsions were used to make coatings for preparing 33 different multilayer color light-sensitive material samples having the compositions and layer constructions shown in Tables 3 and 4 in combination with 4 different coating gelatins having the transmittance and iron ion content values shown in Table 2. The coating liquids were prepared as follows:

Layer 1 coating liquid

Twenty-six point seven grams of yellow coupler Y-1, 10.0 g of dye image stabilizer ST-1, 6.67 g of ST-2, 0.67 g of additive HQ-1 and 6.67 g of high-boiling organic solvent DNP were dissolved by adding 60 ml of ethyl acetate thereto. This solution was emulsifiedly dispersed by means of a supersonic homogenizer into 220 ml of an aqueous 10% gelatin solution containing 9.5 ml of 15% surfactant SU-1 to thereby obtain a yellow coupler dispersion. The obtained yellow coupler dispersion, the silver halide emulsion shown in Table 4, coating gelatin liquid and an antifoggant were mixed to be dissoled, whereby a layer 1 coating liquid having the composition shown in Table 3 was prepared.

Layers 1 to 7 coating liquids

Coating liquids for Layers 1 to 7 were prepared in the same manner as in the above Layer 1 coating liquid except that hardener H-1 was added to Layers 2 to 4 coating liquids, H-2 to Layer 7 coating liquid, and surfactants SU-2 and SU-3 as coating aids were added for surface tension adjustment.

TABLE 1

| | Time interval between the additions of sodium thiosulfate and chloro auric acid | Difference between the speeds right before adding chloroauric acid and before chemical ripening (log E) |
|---|---|---|
| B-1 | 0 minute | — |
| B-2 | 30 minutes | 0.04 |
| B-3 | 90 minutes | 0.11 |
| B-4 | 120 minutes | 0.15 |
| B-5 | 210 minutes | 0.32 |

TABLE 2

| | Kind | *Fe ion content | **α constituent content (wt %) having molecular weight of about 100,000 |
|---|---|---|---|
| Gelatin A | Alkali-treated osein gelatin, limed for 50 days, 1st, 2nd, 3rd extracts*** | 8 ppm | 30 |
| Gelatin B | Alkali-treated osein gelatin, limed for 80 days, 1st, 2nd, 3rd extracts | 3 ppm | 30 |
| Gelatin C | Alkali-treated osein gelatin, limed for 80 days, 1st and 2nd extracts | 8 ppm | 50 |
| Gelatin D | Alkali-treated osein gelatin, limed for 80 days, 1st and 2nd extracts | 3 ppm | 50 |

*Fe ion content adjustment was made by adding calcium chloride to gelatin extract and then by using an anion-exchange resin.

**The α constituent content, having a weight-average molecular weight of about 100,000 is defined in the text of this specification.

***The temperatures of the first, second and third extracts are in the text.

TABLE 3

| Layer | Composition | Adding amt ($g/m^2$) |
|---|---|---|
| Layer 7 (protective layer) | Gelatin | 1.00 |
| | F-1 | 0.002 |

TABLE 3-continued

| Layer | Composition | Adding amt ($g/m^2$) |
|---|---|---|
| Layer 6 (UV absorbing layer) | Gelatin | 0.40 |
| | UV absorbent UV-1 | 0.10 |
| | UV absorbent UV-2 | 0.04 |
| | UV absorbent UV-3 | 0.16 |
| | Antistain agent HQ-1 | 0.01 |
| | DNP | 0.20 |
| | PVP | 0.03 |
| | Antiirradiation agent AI-1 | 0.02 |
| Layer 5 (Red-sensitive layer) | Gelatin | 1.30 |
| | Red-sensitive silver chlorobromide emulsion Em-R1 | 0.21 |
| | Cyan coupler C-1 | 0.26 |
| | Cyan coupler C-2 | 0.09 |
| | Dye image stabilizer ST-1 | 0.20 |
| | Antistain agent HQ-1 | 0.01 |
| | HBS-1 | 0.20 |
| | DOP | 0.20 |
| Layer 4 (UV absorbent layer) | Gelatin | 0.94 |
| | UV absorbent UV-1 | 0.28 |
| | UV absorbent UV-2 | 0.09 |
| | UV absorbent UV-3 | 0.38 |
| | Antistain agent HQ-1 | 0.03 |
| | DNP | 0.40 |
| | Antiirradiation agent AI-2 | 0.01 |
| Layer 3 (Green-sensitive layer) | Gelatin | 1.40 |
| | Green-sensitive silver chlorobromide emulsion Em-G1 | 0.17 |
| | Magenta coupler M-1 | 0.35 |
| | Dye image stabilizer ST-3 | 0.15 |
| | Dye image stabilizer ST-4 | 0.15 |
| | Dye image stabilizer ST-5 | 0.15 |
| | DNP | 0.20 |

TABLE 4

| Layer | Composition | Adding amt ($g/m^2$) |
|---|---|---|
| Layer 2 (Intermediate layer) | Gelatin | 1.20 |
| | Antistain agent HQ-2 | 0.12 |
| | DIDP | 0.15 |
| | Antiirradiation agent AI-3 | 0.01 |
| Layer 1 (Blue-sensitive layer) | Gelatin shown in Table 2 | 1.20 |
| | Blue-sensitive silver chlorobromide emulsion Em-B1 | 0.26 |
| | Yellow coupler Y-1 | 0.80 |
| | Dye image stabilizer ST-1 | 0.30 |
| | Dye image stabilizer ST-2 | 0.20 |
| | Antistain agent HQ-1 | 0.02 |
| | DNP | 0.20 |
| | Compound represented by Formula [I] of the invention | Shown in Table 5 |
| Support | Polyethylene-laminated paper | |

*The adding amount of each silver halide emulsion is shown in silver equivalent.

The additives applied to the above layers are as follows.

H-1: Tetrakis(vinylsulfonylmethyl)methane
H-2: Sodium 2,4-dichloro-6-hydroxy-s-triazine
SU-1: Sodium tri-i-propylnaphthalenesulfonate
SU-2: Sodium di(2-ethylhexyl)sulfosuccinate
SU-3: Sodium di(2,2,3,3,4,4,5,5,-octafluoropentyl)sulfosuccinate
DOP: Dioctyl phthalate
DNP: Dinonyl phthalate
DIDP: Di-i-decyl phthalate
PVP: Polyvinyl pyrrolidone
HBS- 1: 1-Dodecyl-4-(p-toluenesulfonamido)benzene
HBS- 2: A mixture of tri(2-ethylhexyl) phosphate and tricresyl phosphate (in a proportion by weight of 2:1)
HQ-1: 2,5-Di-t-octylhydroquinone
HQ-2: 2-hexadecyl-5-methylhydroquinone
F-1: 5-chloro-2-methyl-isothiazoline-3-one.

Y-1
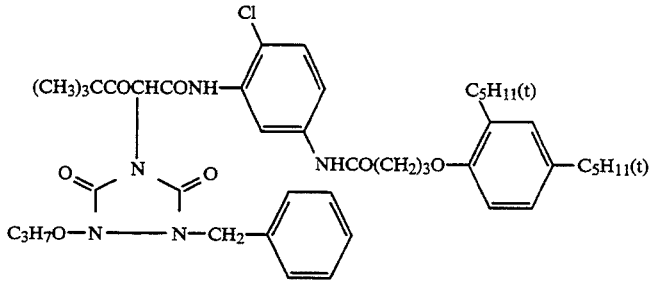
M-1
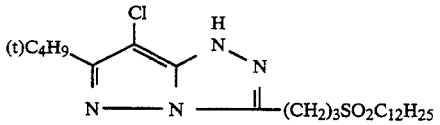
C-1
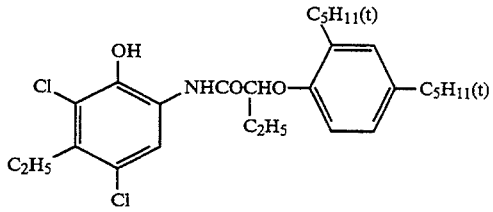
C-2
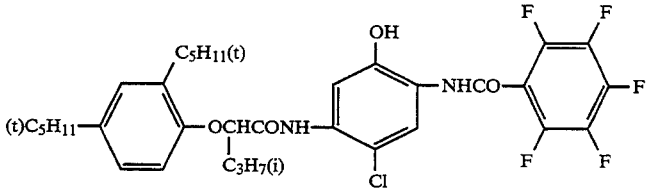
ST-1
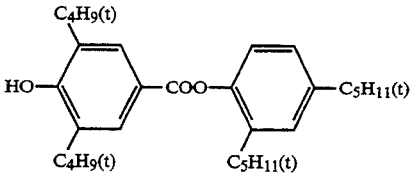
ST-2
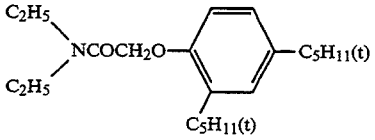
ST-3
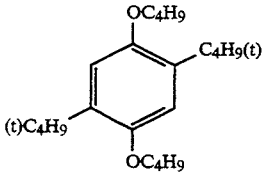
ST-4
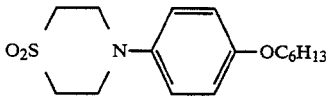
ST-5
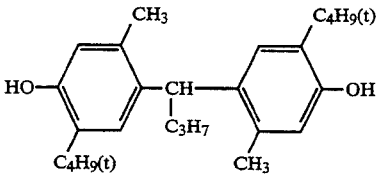
UV-1
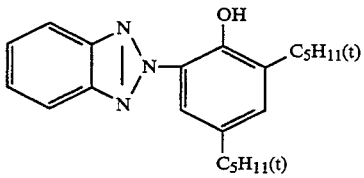
F-1
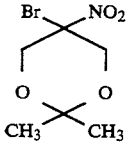
UV-2
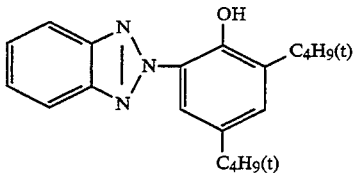
UV-3
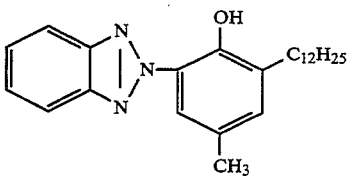

-continued

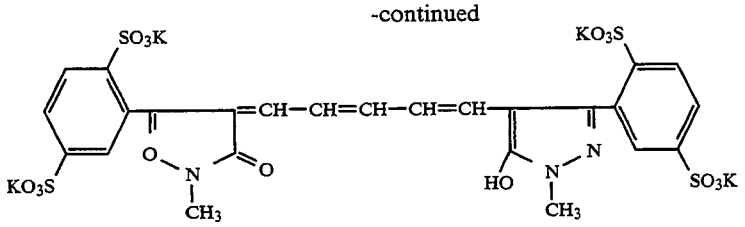

AI-1

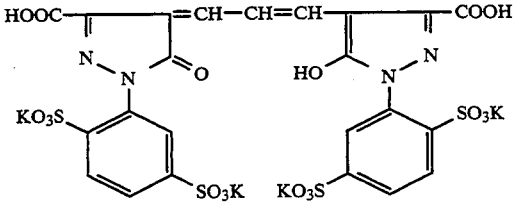

AI-2

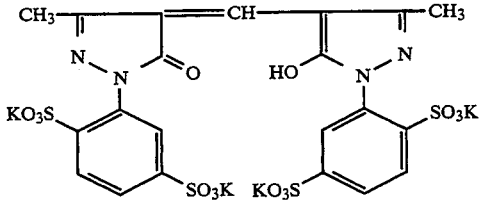

AI-3

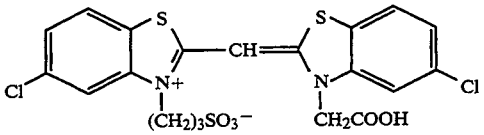

BS-1

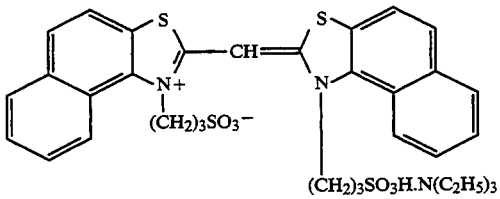

BS-2

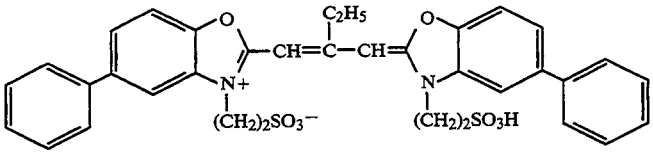

GS-1

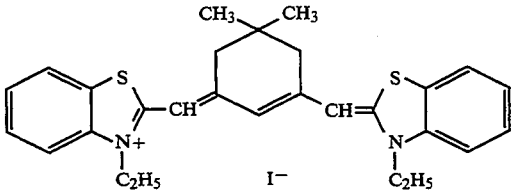

RS-1

Each of the prepared samples was divided into two; one is for initial latent image stability tests, while the other for aging storage stability tests.

Initial latent image stability

The part prepared for initial latent image stability tests was further divided into two subparts; one was processed in the following steps in a very short time (within 5 seconds) after being exposed through a wedge in the usual manner (immediate sample), while the remaining was processed likewise 5 minutes after the wedge exposure (5-minute-elapse sample). The density measurement of each of these processed samples was carried out by means of an optical densitometer PDA-65, manufactured by KONICA Corp., to find its sensitivity, which is defined by the logarithm of the reciprocal of an exposure necessary to obtain a density 0.75 higher than a fog density. The gradation was defined by the average inclination of the characteristic curve formed between the density points of 0.5 to 1.0.

Aging storage stability

The part prepared for aging torage stability tests was further divided into two subparts; one was allowed to stand at 50° C./80% RH for three days, while the other was stored in a freezer at −10° C. over a period of 3 days, then wedge-exposed in the usual manner, and 5 minutes thereafter was subjected to the same processing and density measurement as were done in the above initial latent image stability test, whereby fog and sensitivity values were obtained.

| Processing steps | | |
|---|---|---|
| Processing step | Temperature | Time |
| Color developing | 35.0 ± 0.3° C. | 45 seconds |
| Bleach-fix | 35.0 ± 0.5° C. | 45 seconds |
| Stabilizing | 30 to 34° C. | 90 seconds |
| Drying | 60 to 80° C. | 60 seconds |

The compositions of the processing solutions used are as follows:

| Color developer | |
|---|---|
| Pure water | 800 ml |
| Triethylenediamine | 2 g |
| Diethylene glycol | 10 g |
| Potassium bromide | 0.01 g |
| Potassium chloride | 3.5 g |
| Potassium sulfite | 0.25 g |
| N-ethyl-N-(β-methanesulfonamidoethyl)-3-methyl-4-aminoaniline sulfate | 6.0 g |
| N,N-diethylhydroxylamine | 6.8 g |
| Triethanolamine | 10.0 g |
| Sodium diethylenetriaminepentaacetate | 2.0 g |
| Brightening agent (4,4'-diaminostilbene- | 2.0 g |

-continued

| | |
|---|---|
| sulfonic acid derivative) | |
| Potassium carbonate | 30 g |
| Water to make 1 liter with pH adjusted to 10.10. | |
| Bleach-fix bath | |
| Ferric-ammonium diethylenetriaminepenta-acetate, dihydrated | 65 g |
| Diethylenetriaminepentaacetic acid | 3 g |
| Ammonium thiosulfate (70% aqueous solution) | 100 ml |
| 5-Amino-1,3,4-thiadiazole-2-thiol | 2.0 g |
| Ammonium sulfite (40% aqueous solution) | 27.5 ml |
| Water to make 1 liter with pH adjusted to 6.5 with potassium carbonate or glacial acetic acid. | |
| Stabilizing bath | |
| o-Phenyl-phenol | 1.0 g |
| 5-Chloro-2-methyl-4-isothiazoline-3-one | 0.02 g |
| 2-methyl-4-isothiazoline-3-one | 0.02 g |
| Diethylene glycol | 1.0 g |
| Brightening agent (Cinopal SFP) | 2.0 g |
| 1-hydroxyethylidene-1,1-diphosphonic acid | 1.8 g |
| $BiCl_3$ (45% aqueous solution) | 0.65 g |
| $MgSO_4.7H^2O$ | 0.2 g |
| PVP (polyvinyl pyrrolidone) | 1.0 g |
| Ammonia water (25% ammonium hydroxide solution) | 2.5 g |
| Trisodium nitriloacetate | 1.5 g |
| Water to make 1 liter with pH adjusted to 7.5 with sulfuric acid or ammonia water. | |

TABLE 5

| No. | Silver halide emulsion | Coated gelatin 4.8% | Antifoggant (Table A) Cpd. | Antifoggant (Table A) ($\times 10^{4}$mol/mol Ag) | Initial latent image stability: Δ Sensitivity (5-min-elapse/immediate) | Initial latent image stability: Δ Gradation (5-min-elapse/immediate) |
|---|---|---|---|---|---|---|
| 1 | B-1 | A | — | — | −15% | +0.85% |
| 2 | " | B | — | — | −15% | +0.80% |
| 3 | " | C | — | — | −14% | +0.87 |
| 4 | " | D | — | — | −10% | +0.70 |
| 5 | " | D | 1 | 4.0 | −10% | +0.65 |
| 6 | " | D | 26 | 4.0 | −10% | +0.65 |
| 7 | B-2 | A | — | — | −10% | +0.26 |
| 8 | " | B | — | — | −9% | +0.18 |
| 9 | " | C | — | — | −11% | +0.19 |
| 10 | " | D | — | — | −6% | +0.10 |
| 11 | B-3 | A | — | — | −5% | +0.10 |
| 12 | " | A | 1 | 4.0 | −5% | +0.10 |
| 13 | " | B | — | — | −3% | +0.15 |
| 14 | " | B | 1 | 4.0 | −3% | +0.15 |
| 15 | " | C | — | — | −1% | +0.13 |
| 16 | " | C | 1 | 4.0 | −1% | +0.12 |
| 17 | " | D | — | — | 0% | +0.08 |
| 18 | " | D | 1 | 4.0 | 0% | +0.06 |
| 19 | " | D | 7 | 2.6 | −1% | +0.08 |
| 20 | " | D | 13 | 3.0 | −2% | +0.08 |
| 21 | " | D | 26 | 4.0 | −1% | +0.09 |
| 22 | B-4 | A | — | — | +10% | +0.15 |
| 23 | " | B | — | — | +8% | +0.16 |
| 24 | " | C | — | — | +9% | +0.15 |
| 25 | " | D | — | — | +4% | +0.10 |
| 26 | " | D | 1 | 4.0 | +2% | +0.09 |
| 27 | " | D | 13 | 3.0 | +3% | +0.11 |
| 28 | B-5 | A | — | — | +19% | −0.35 |
| 29 | " | B | — | — | +18% | −0.40 |
| 30 | " | C | — | — | +17% | −0.42 |
| 31 | " | D | — | — | +15% | −0.40 |
| 32 | " | D | 27 | 4.0 | +13% | −0.35 |
| 33 | " | D | 47 | 4.0 | +10% | −0.40 |

TABLE 6

| Sample No. | | Relative speed: Fresh | Relative speed: 50° C./80% RH | Fog: Fresh | Fog: 50° C./80% RH |
|---|---|---|---|---|---|
| 1 | (Comparative) | 100(ref.) | 110 | +0.05 | +0.10 |
| 2 | " | 100 | 115 | +0.04 | +0.09 |
| 3 | " | 103 | 110 | +0.05 | +0.13 |
| 4 | (Invention) | 105 | 108 | +0.04 | +0.07 |
| 5 | " | 107 | 110 | +0.03 | +0.05 |
| 6 | " | 101 | 105 | +0.03 | +0.06 |

TABLE 6-continued

| Sample No. | | Relative speed: Fresh | Relative speed: 50° C./80% RH | Fog: Fresh | Fog: 50° C./80% RH |
|---|---|---|---|---|---|
| 7 | (Comparative) | 105 | 113 | +0.05 | +0.15 |
| 8 | " | 107 | 112 | +0.04 | +0.10 |
| 9 | " | 107 | 112 | +0.05 | +0.09 |
| 10 | (Invention) | 106 | 109 | +0.04 | +0.06 |
| 11 | (Comparative) | 125 | 133 | +0.06 | +0.11 |
| 12 | " | 120 | 127 | +0.05 | +0.10 |
| 13 | " | 130 | 137 | +0.04 | +0.10 |
| 14 | " | 126 | 131 | +0.03 | +0.09 |
| 15 | " | 125 | 130 | +0.05 | +0.09 |
| 16 | " | 121 | 126 | +0.04 | +0.08 |
| 17 | (Invention) | 125 | 126 | +0.03 | +0.04 |
| 18 | " | 120 | 120 | +0.02 | +0.02 |
| 19 | " | 117 | 117 | +0.02 | +0.02 |
| 20 | " | 118 | 119 | +0.03 | +0.04 |
| 21 | " | 125 | 123 | +0.03 | +0.03 |
| 22 | (Comparative) | 135 | 145 | +0.10 | +0.16 |
| 23 | " | 142 | 150 | +0.06 | +0.13 |
| 24 | " | 140 | 147 | +0.08 | +0.10 |
| 25 | (Invention) | 140 | 145 | +0.04 | +0.06 |
| 26 | " | 137 | 140 | +0.04 | +0.04 |
| 27 | " | 135 | 139 | +0.05 | +0.06 |
| 28 | (Comparative) | 147 | 162 | +0.15 | +0.21 |
| 29 | " | 150 | 160 | +0.13 | +0.20 |
| 30 | " | 145 | 157 | +0.16 | +0.22 |
| 31 | (Invention) | 140 | 150 | +0.10 | +0.13 |
| 32 | " | 135 | 140 | +0.06 | +0.08 |
| 33 | " | 133 | 139 | +0.08 | +0.10 |

From the results shown in Tables 5 and 6 it is understood that the use of the gelatin of the invention in silver halide emulsion coating liquids, regardless of the chemical sensitization process applied to the silver halide emulsion, is very effective in reducing not only the sensitivity and gradation fluctuations in the initial latent image stability but also fog of the emulsion in the fresh state, and also reduces changes in the sensitivity and fog even in the aging storage under high temperature/high humidity conditions. Further, Emulsions B-3 and Emulsions B-4, obtained by being sulfur-sensitized for 90 minutes and 120 minutes to have their speeds increased by Log E 0.11 and Log E 0.15, respectively, and thereafter being gold-sensitized, show much smaller changes in the sensitivity and fog during the aging storage as well as in the sensitivity in the initial latent image stability when combined with the gelatin of the invention. Those prepared by further adding antifoggants to the samples containing the gelatin of the invention show still smaller changes in the sensitivity and fog during the aging storage thereof, which is considered as a synergetic effect with the gelatin of the invention.

Example 2

Tests were made by applying the foregoing different-type gelatins to coating liquids for forming the green-sensitive emulsion and red-sensitive emulsion layers in the same manner as in Example 1. Consequently, the same improved results as in Example 1 were obtained on the initial latent image stability as well as on the aging storage stability, from which it is understood that an excellent multilayer color photographic light-sensitive material having uniform B, G and R characteristics can be obtained.

Example 3

Tests were made with samples prepared by using the gelatins of the invention in their nonlight-sensitive layers. As a result it was found that the use of the gelatins of the invention is very effective in restraining the samples from fogging during the aging storage thereof.

What is claimed is:

1. A silver halide photographic light-sensitive material comprising a support and having thereon at least one silver halide emulsion layer, wherein the silver halide emulsion layer contains silver chloro-bromide grains having a silver chloride content of at least 95 mol % and a gelatin comprising an iron ion of 0.5 ppm to 5 ppm and at least 40% by weight, based on said gelatin, of an $\alpha$-constituent having weight-average molecular weight of 80,000 to 120,000.

2. The silver halide photographic light-sensitive material of claim 1, wherein said gelatin comprises $\alpha$-constituent having weight-average molecular weight of 80,000 to 120,000 in an amount of not less than 45% by weight of the gelatin.

3. The silver halide photographic light-sensitive material of claim 1, wherein said gelatin comprises a high molecular weight constituent of the gelatin in an amount of not more than 3% by weight of the gelatin.

4. The silver halide photographic light-sensitive material of claim 1, wherein the gelatin has the jelly strength of not less than 250 g.

5. The silver halide photographic light-sensitive material of claim 1, wherein the gelatin has a calcium content in an amount of not more than 6000 ppm by weight of the gelatin.

6. The silver halide photographic light-sensitive material of claim 1, wherein the gelatin has a calcium content in an amount of not more than 5000 ppm by weight of the gelatin.

7. The silver halide photographic light-sensitive material of claim 1, wherein the silver halide emulsion layer comprising a sulfur sensitization process and then, a gold sensitization process.

8. The silver halide photographic light-sensitive material of claim 7, wherein the sulfur sensitization is employed by the compounds selected from the group consisting of thiosulfates, allylthiocarbamide, thiourea, allylisothiocyanate, cystine, p-toluenesulfonate, rhodanine and inorganic sulfur.

9. The silver halide photographic light-sensitive material of claim 8, wherein the addition amount of the compounds is within the range of $10^{-7}$ mol to $10^{-3}$ mol per mol of a silver halide.

10. The silver halide photographic light-sensitive material of claim 8, wherein the addition amount of the compounds is within the range of $10^{-6}$ mol to $10^{-5}$ mol per mol of a silver halide.

11. The silver halide photographic light-sensitive material of claim 7, wherein the gold sensitization is employed by the chelate complex of the compound selected from the group consisting of chloroauric acid, gold sulfide and gold thiosulfate.

12. The silver halide photographic light-sensitive material of claim 11, wherein a chelating agent of said chelate complex is selected from the group consisting of dimethyl rhodanine, thiocyanic acid, mercaptotetrazole and mercaptotriazole.

13. The silver halide photographic light-sensitive material of claim 1, comprising an anti-foggant represented by Formula I:

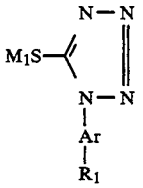

Formula I wherein Ar represents an aromatic group, $R_1$ represents $-OR_2$, $-N(R_3)SO_2R_4$ or $-COOM_2$, wherein $R_2$ is a hydrocarbon group having two or more carbons, $R_3$ is a hydrogen atom or a hydrocarbon group, $R_4$ is a hydrocarbon group, $M_1$ and $M_2$ each represent a hydrogen atom, an alkali metal atom, an alkaline earth metal atom or an ammonium group.

* * * * *